US011506990B2

(12) United States Patent
Kasuya et al.

(10) Patent No.: US 11,506,990 B2
(45) Date of Patent: Nov. 22, 2022

(54) LIGHT EMITTING DEVICE, EXPOSURE DEVICE, AND IMAGE FORMING APPARATUS

(71) Applicant: FUJIFILM Business Innovation Corp., Tokyo (JP)

(72) Inventors: Yosuke Kasuya, Kanagawa (JP); Akihiko Endo, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 12 days.

(21) Appl. No.: 17/148,536

(22) Filed: Jan. 13, 2021

(65) Prior Publication Data

US 2022/0082955 A1 Mar. 17, 2022

(30) Foreign Application Priority Data

Sep. 11, 2020 (JP) ..... JP2020-153345

(51) Int. Cl.
*G03G 15/04* (2006.01)

(52) U.S. Cl.
CPC ..... *G03G 15/04036* (2013.01)

(58) Field of Classification Search
CPC ..... G03G 15/04036
See application file for complete search history.

(56) References Cited

U.S. PATENT DOCUMENTS 9,989,881 B2 6/2018 Kasuya et al.
2018/0275556 A1* 9/2018 Nagamine ..... G03G 15/04036

FOREIGN PATENT DOCUMENTS

JP 2010076130 A * 4/2010
JP 2018001567 1/2018

OTHER PUBLICATIONS

English machine translation of Japanese patent document JP 2010-076130 A (Year: 2010).*

* cited by examiner

*Primary Examiner* — Walter L Lindsay, Jr.
*Assistant Examiner* — Geoffrey T Evans
(74) *Attorney, Agent, or Firm* — JCIPRNET

(57) ABSTRACT

A light emitting device includes a resin housing that extends in one direction and holds a light emitting unit emitting light upward in a height direction intersecting the one direction, the housing having, on an upper side and a lower side of each of both end portions in the one direction, a positioned portion, which comes into contact with a positioning member in the height direction, and a biased portion, which receives a biasing force from a biasing unit biasing the housing to bring the positioned portion into contact with the positioning member, and a suppressing member that extends in the one direction and is fixed to the housing to suppress deformation of the housing, at least one end portion of the suppressing member in the one direction being interposed between the biased portion and the biasing unit.

17 Claims, 8 Drawing Sheets

LIGHT EMITTING DEVICE, EXPOSURE DEVICE, AND IMAGE FORMING APPARATUS

CROSS-REFERENCE TO RELATED APPLICATIONS

This application is based on and claims priority under 35 USC 119 from Japanese Patent Application No. 2020-153345 filed Sep. 11, 2020.

BACKGROUND

(i) Technical Field

The present invention relates to a light emitting device, an exposure device, and an image forming apparatus.

(ii) Related Art

An exposure device including a plate-shaped body portion that extends in one direction, a plurality of light emitting elements that are mounted on one surface of the body portion, a substrate that is mounted on the other surface of the body portion and has a heat generating element, which generates heat as the light emitting element emits light, a resin housing that extends in the one direction, has a frame shape, in which a through-hole is formed, the through-hole having an inside fixed to the substrate such that a plate thickness direction of the substrate is a penetration direction of the through-hole, and a suppressing member that extends in the one direction, is fitted in the through-hole, and suppresses the thermal deformation of the housing is described in JP2018-001567A.

SUMMARY

Aspects of non-limiting embodiments of the present disclosure relate to, in a configuration where a suppressing member, which suppresses the deformation of a housing, is fixed to the housing, suppressing the deformation of the housing caused by the weight of the suppressing member, compared to a configuration where the housing directly receives a biasing force from a biasing unit with a biased portion.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a light emitting device including a resin housing that extends in one direction and holds a light emitting unit emitting light upward in a height direction intersecting the one direction, the housing having, on an upper side and a lower side of each of both end portions in the one direction, a positioned portion, which comes into contact with a positioning member in the height direction, and a biased portion, which receives a biasing force from a biasing unit biasing the housing to bring the positioned portion into contact with the positioning member, and a suppressing member that extends in the one direction and is fixed to the housing to suppress deformation of the housing, at least one end portion of the suppressing member in the one direction being interposed between the biased portion and the biasing unit.

BRIEF DESCRIPTION OF THE DRAWINGS

Exemplary embodiment(s) of the present invention will be described in detail based on the following figures, wherein.

DETAILED DESCRIPTION

Examples of a light emitting device, an exposure device, and an image forming apparatus according to an exemplary embodiment of the present invention will be described with reference to FIGS. 1 to 8.

In the description below, an apparatus up-and-down direction (height direction), an apparatus width direction (horizontal direction), and an apparatus depth direction (horizontal direction) in a case where an image forming apparatus 10 is viewed from the front from a side where a user (not illustrated) stands will be described as an H-direction, a W-direction, and a D-direction, respectively. In addition, in a case where distinguishing between one side and the other side in each of the apparatus up-and-down direction is required, the apparatus width direction, and the apparatus depth direction, an upper side will be described as a +H side, a lower side will be described as a −H side, a right side will be described as a +W side, a left side will be described as a −W side, a back side will be described as a −D side, and a front side will be described as a +D side, in front view of the image forming apparatus 10.

Image Forming Apparatus 10

Figure 8:
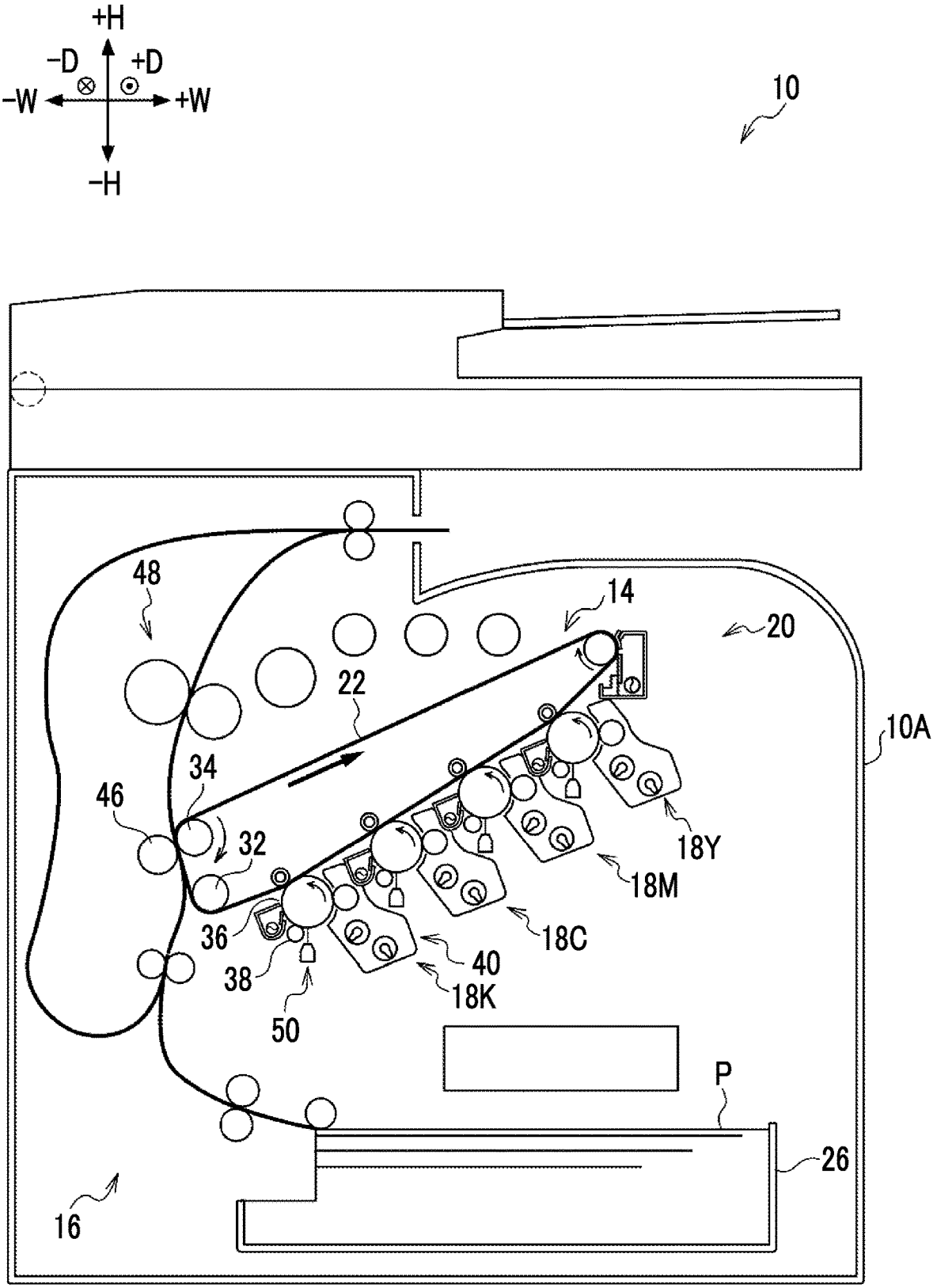
FIG. 8 is a schematic front view illustrating a configuration of an image forming apparatus according to the exemplary embodiment of the present invention.

The image forming apparatus 10 according to the present exemplary embodiment is an electrophotographic image forming apparatus that forms and fixes a toner image on a sheet member P, which is a recording medium. As illustrated in FIG. 8, the image forming apparatus 10 includes a housing 10A, which is an apparatus body, an accommodating unit 26, a transporting unit 16, and an image forming unit 20. The accommodating unit 26 has a function of accommodating the sheet member P. The transporting unit 16 has a function of transporting the sheet member P accommodated in the accommodating unit 26 to an image forming unit 20 side.

The image forming unit 20 has photoconductor units 18Y, 18M, 18C, and 18K, a transfer unit 14, and a fixing unit 48. The reference signs at the end indicate that "Y" is for yellow, "M" is for magenta, "C" is for cyan, and "K" is for black.

The photoconductor units 18Y, 18M, 18C, and 18K are disposed inside the housing 10A in an arranged state in a case of being viewed from the front of the image forming apparatus 10. The photoconductor units 18Y, 18M, 18C, and 18K are configured the same except for a toner (not illustrated) to be used. For this reason, the reference sign showing the configuration of the photoconductor unit will be assigned with respect to the photoconductor unit 18K, and the photoconductor units 18Y, 18M, and 18C will be omitted. In addition, in a case where the photoconductor units 18Y, 18M, 18C, and 18K are not particularly distinguished, the alphabet letters at the end will be omitted.

The photoconductor unit 18 includes a photoconductor drum 36, a charging device 38, an exposure device 50, and a developing device 40. The photoconductor drum 36 is rotatably provided with a direction in which the image forming apparatus 10 is viewed from the front as an axial direction, and is rotated counterclockwise by a motor (not illustrated) in a case of being viewed from the front of the image forming apparatus 10. In addition, the photoconductor drum 36 has a function of holding an electrostatic latent image on an outer peripheral surface. The photoconductor drum 36 is an example of an image holder. The charging device 38 has a function of charging the outer peripheral surface of the photoconductor drum 36 to a potential determined in advance. The exposure device 50 is arranged at a position separated away from the photoconductor drum 36 by a distance determined in advance. The exposure device 50 has a function of forming an image of light on the charged photoconductor drum 36 to form an electrostatic latent image. The developing device 40 has a function of developing the electrostatic latent image formed on the photoconductor drum 36 with the use of a developing agent (not illustrated), including a toner, to form a toner image. Details of the exposure device 50 will be described later.

Figure 1:
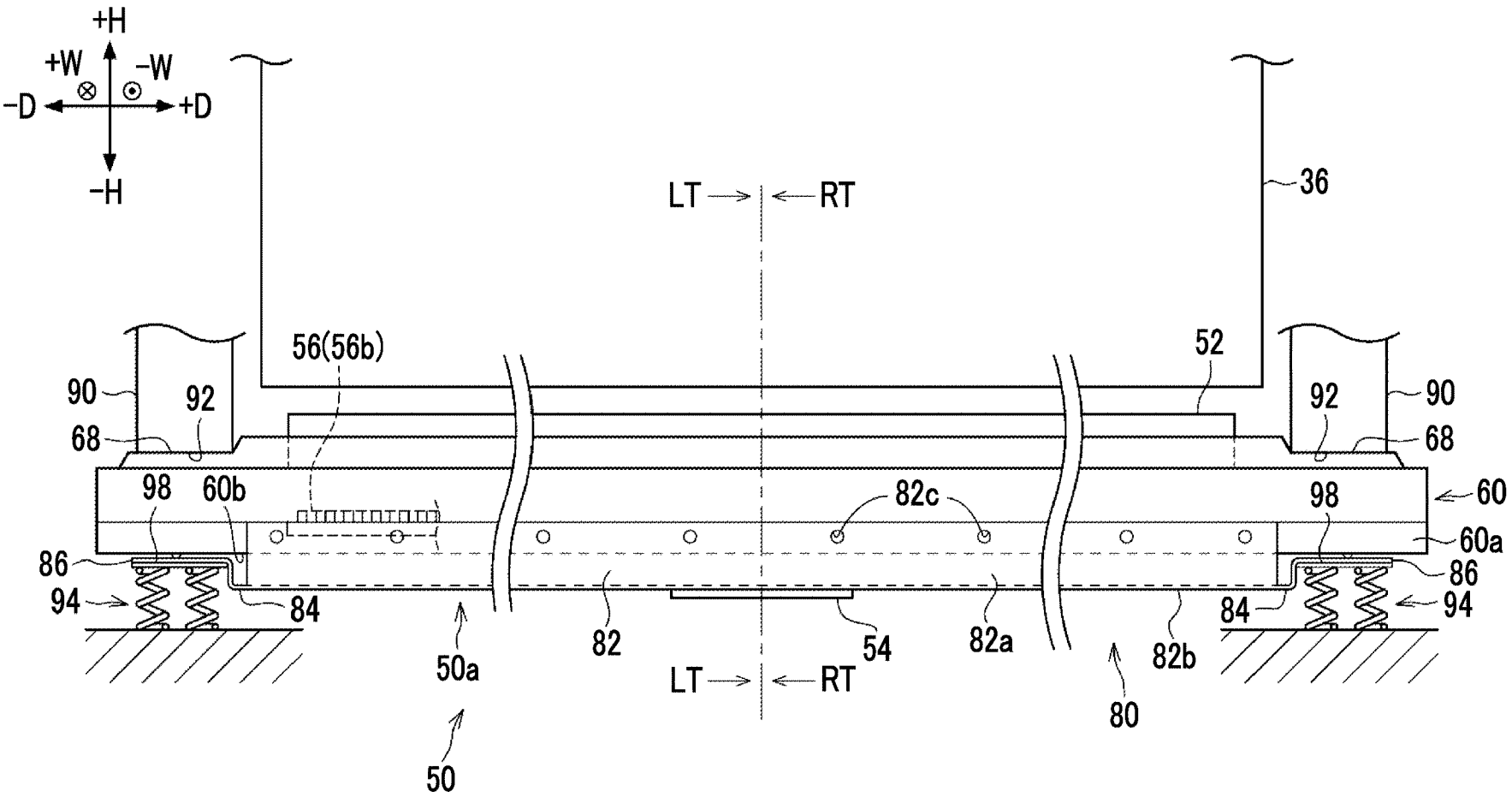
FIG. 1 is a side view of an exposure device according to an exemplary embodiment of the present invention.

In addition, as illustrated in FIG. 1, the photoconductor unit 18 further includes a positioning member 90 that comes into contact with a flat portion 68 of the exposure device 50, which is to be described later, and positions a position of the exposure device 50 with respect to the photoconductor drum 36. In addition, the photoconductor unit 18 further includes a biasing unit 94 that biases the exposure device 50 such that the flat portion 68 of the exposure device 50 comes into contact with the positioning member 90. Details of the positioning member 90 and the biasing unit 94 will be described later.

The transfer unit 14 is configured to include an intermediate transfer belt 22, a plurality of primary transfer rollers 44, a drive roller 32, a secondary transfer roller 34, and a facing roller 46. The intermediate transfer belt 22 is an endless belt of which an inner peripheral surface is supported by the primary transfer rollers 44, the drive roller 32, and the secondary transfer roller 34, and is moved around clockwise by the drive roller 32 in a case of being viewed from the front of the image forming apparatus 10.

The transfer unit 14 has a function of transferring, via the intermediate transfer belt 22, a toner image formed by the photoconductor units 18Y, 18M, 18C, and 18K on the sheet member P transported from the transporting unit 16 and transporting the sheet member to the fixing unit 48.

The fixing unit 48 has a function of fixing the toner image, which is transferred on the sheet member P by the transfer unit 14, on the sheet member P, and sends the sheet member P outside the apparatus.

Exposure Device 50

Next, the exposure device 50 will be described.

Figure 2:
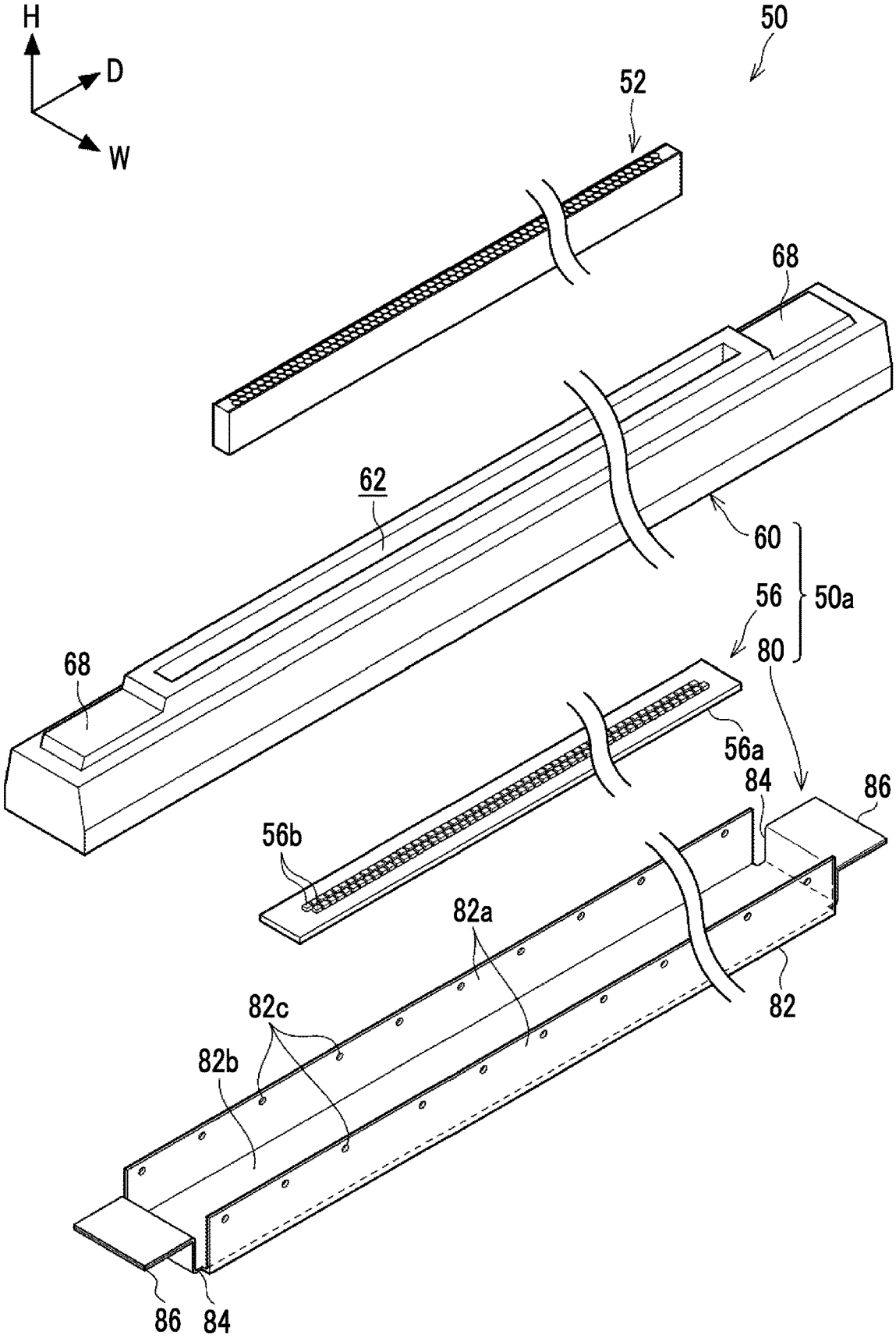
FIG. 2 is an exploded perspective view of the exposure device according to the exemplary embodiment of the present invention.

As illustrated in FIG. 2, the exposure device 50 includes a light emitting device 50*a*, a lens array 52, and a weight 54 (refer to FIG. 1). The light emitting device 50*a* includes a housing 60, a light emitting substrate 56, and a suppressing member 80. As for description of the exposure device 50, the housing 60, the light emitting substrate 56, the lens array 52, the suppressing member 80, and the weight 54 will be described in this order.

Housing 60

Figure 3:
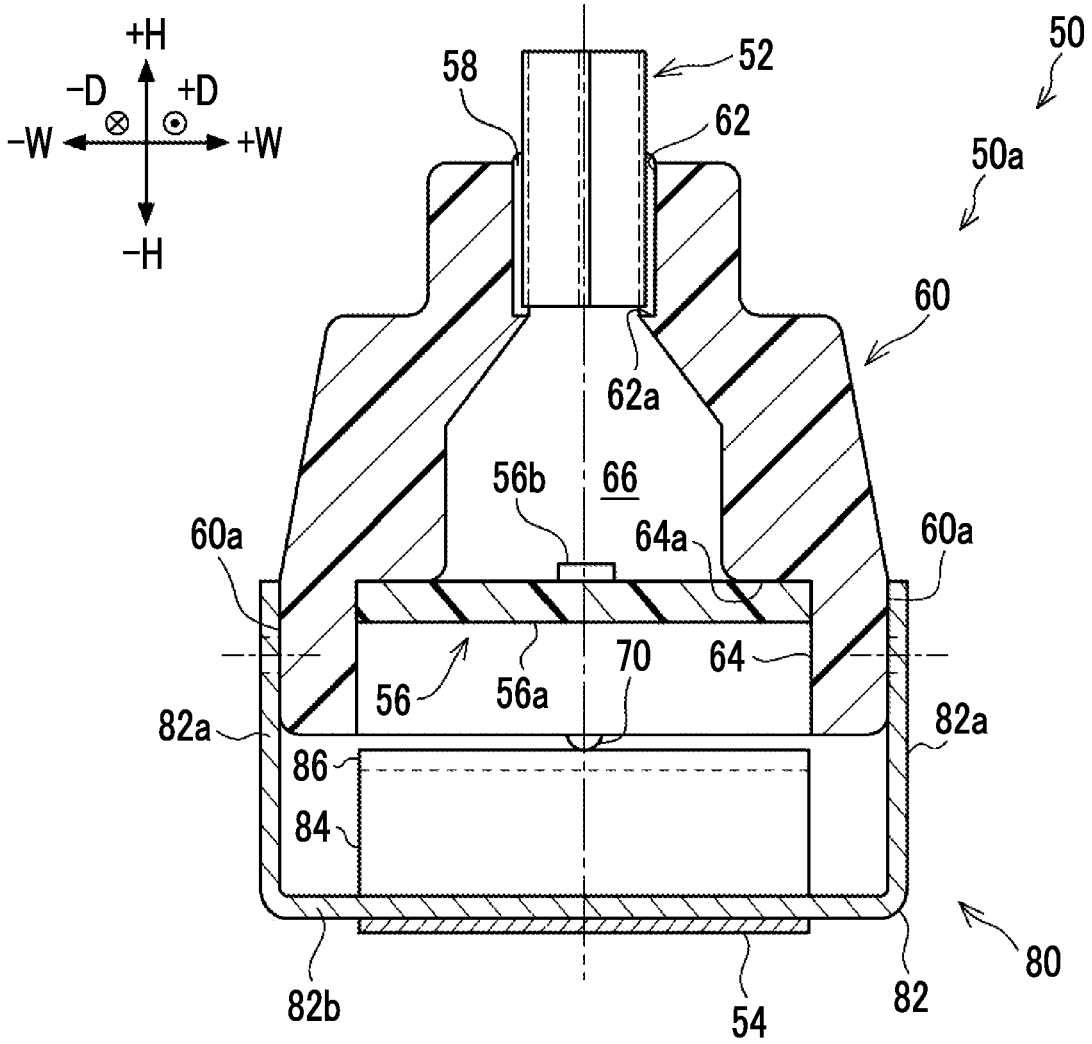
FIG. 3 is a sectional view taken along line RT-RT of FIG. 1.
Figure 4:
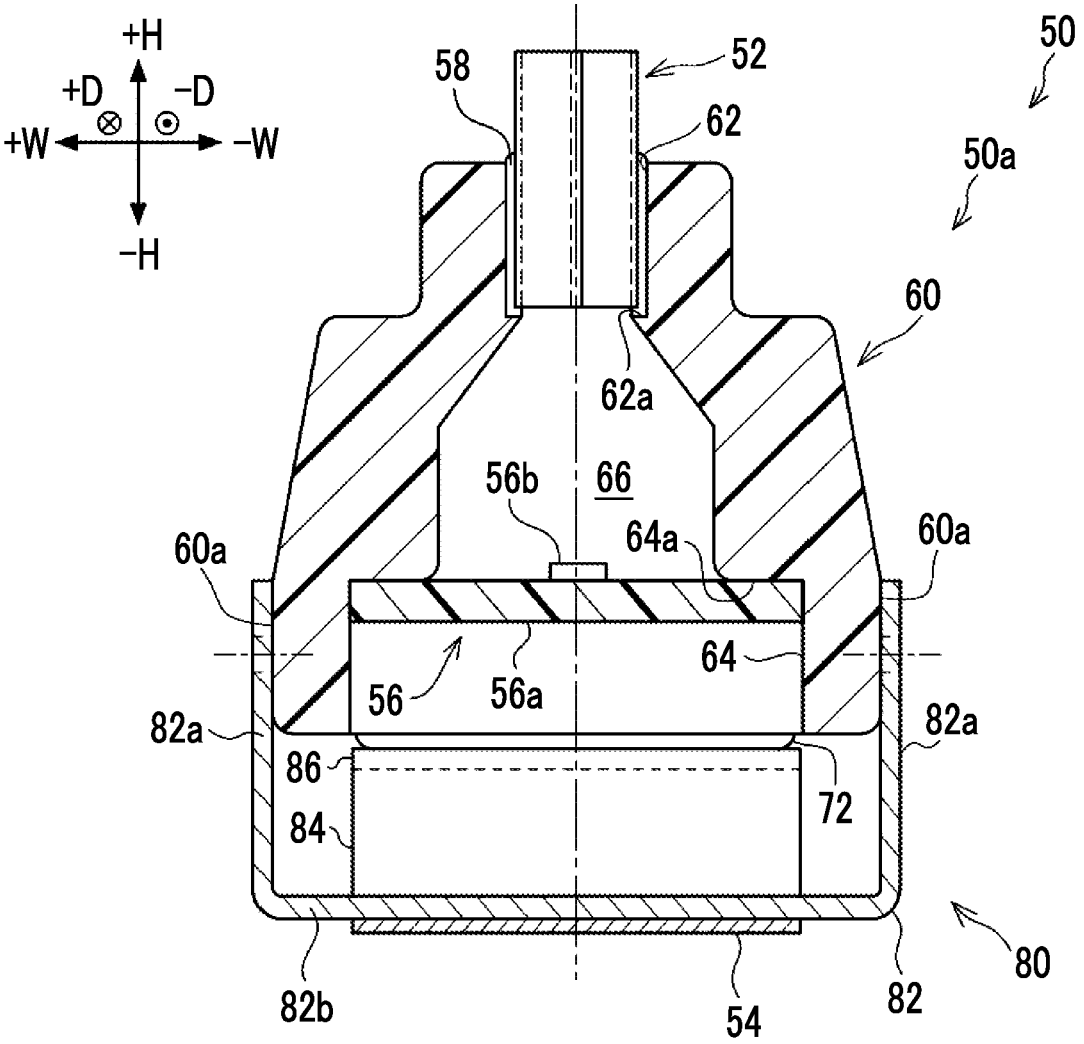
FIG. 4 is a sectional view taken along line LT-LT of FIG. 1.
Figure 5:
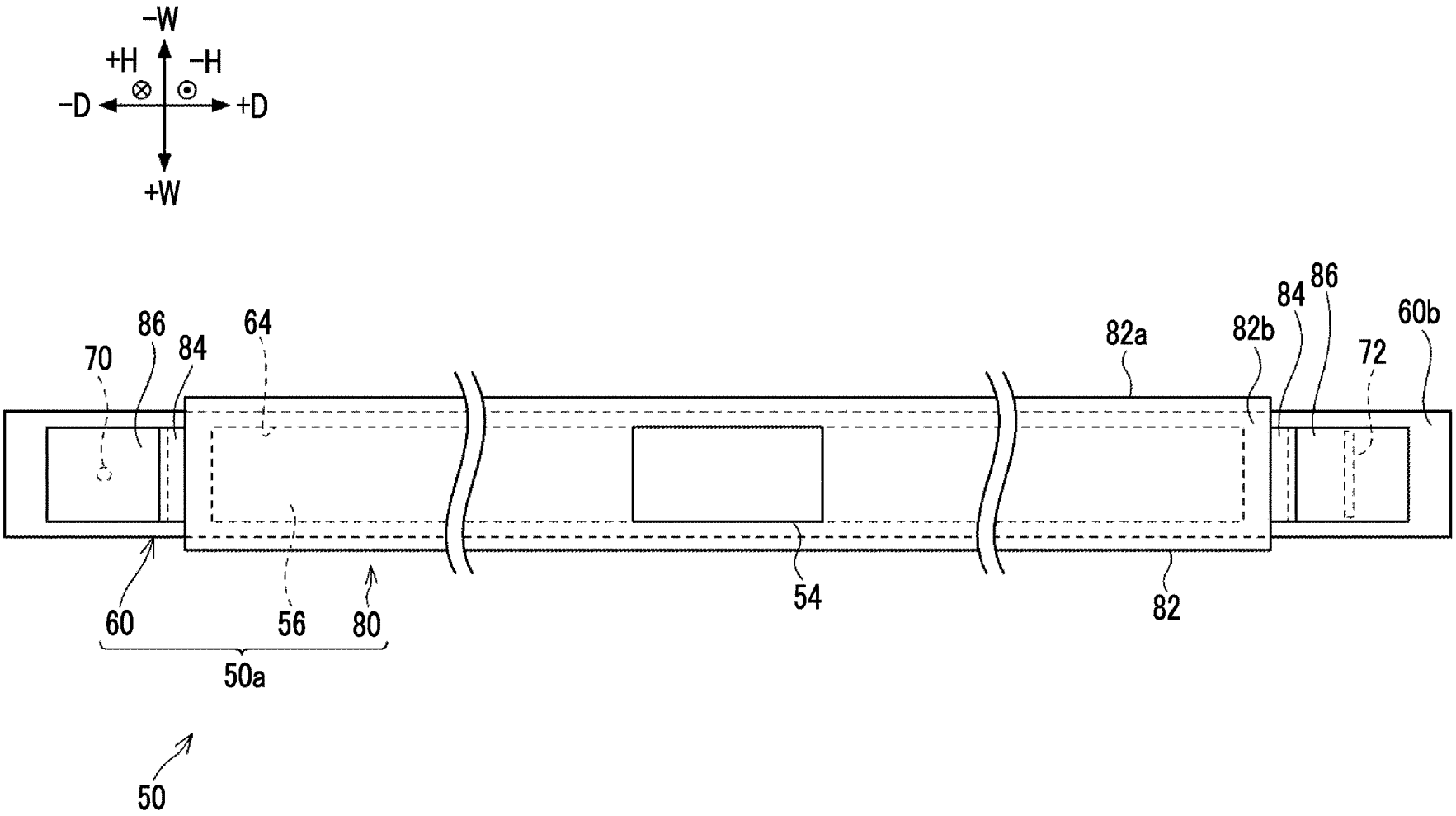
FIG. 5 is a bottom view of the exposure device according to the exemplary embodiment of the present invention.

As illustrated in FIGS. 2 to 4, the housing 60 is a resin member that extends in the apparatus depth direction and has an upper surface portion and a lower surface portion along the apparatus depth direction and the apparatus width direction. The housing 60 has a side surface portion 60*a* along the apparatus depth direction and the apparatus up-and-down direction. The lower surface portion of the housing 60 refers to a lower surface portion 60*b*. In the housing 60, an upper recessed portion 62 that is recessed in a rectangular shape in the upper surface portion of the housing 60 and has a bottom surface 62*a* along the apparatus depth direction and the apparatus width direction is formed. In addition, in the housing 60, a lower recessed portion 64 that is recessed in a rectangular shape in the lower surface portion 60*b* of the housing 60 and has a bottom surface 64*a* along the apparatus depth direction and the apparatus width direction is formed. Further, a through-hole 66 that penetrates through a space between the bottom surface 62*a* of the upper recessed portion 62 and the bottom surface 64*a* of the lower recessed portion 64 in the apparatus up-and-down direction is formed in the housing 60.

The flat portions 68 facing upward are formed at both end portions of the upper surface portion of the housing 60 in the apparatus depth direction. As the flat portion 68 of the housing 60 comes into contact with the positioning member 90 of the photoconductor unit 18, the position of the exposure device 50 with respect to the photoconductor drum 36 in the apparatus up-and-down direction is positioned. The flat portion 68 is an example of a positioned portion.

A part of the lower surface portion 60*b* of the housing 60 on each of both end sides in the apparatus depth direction comes into contact with an end portion 86 of the suppressing member 80, which is to be described later. In addition, the lower surface portion 60*b* of the housing 60 is a part that receives a biasing force of the biasing unit 94 biasing the housing 60 via the end portion 86 to bring the flat portion 68 of the housing 60 into contact with the positioning member 90 of the photoconductor unit 18. The lower surface portion 60*b* is an example of a biased portion.

Figure 6A:
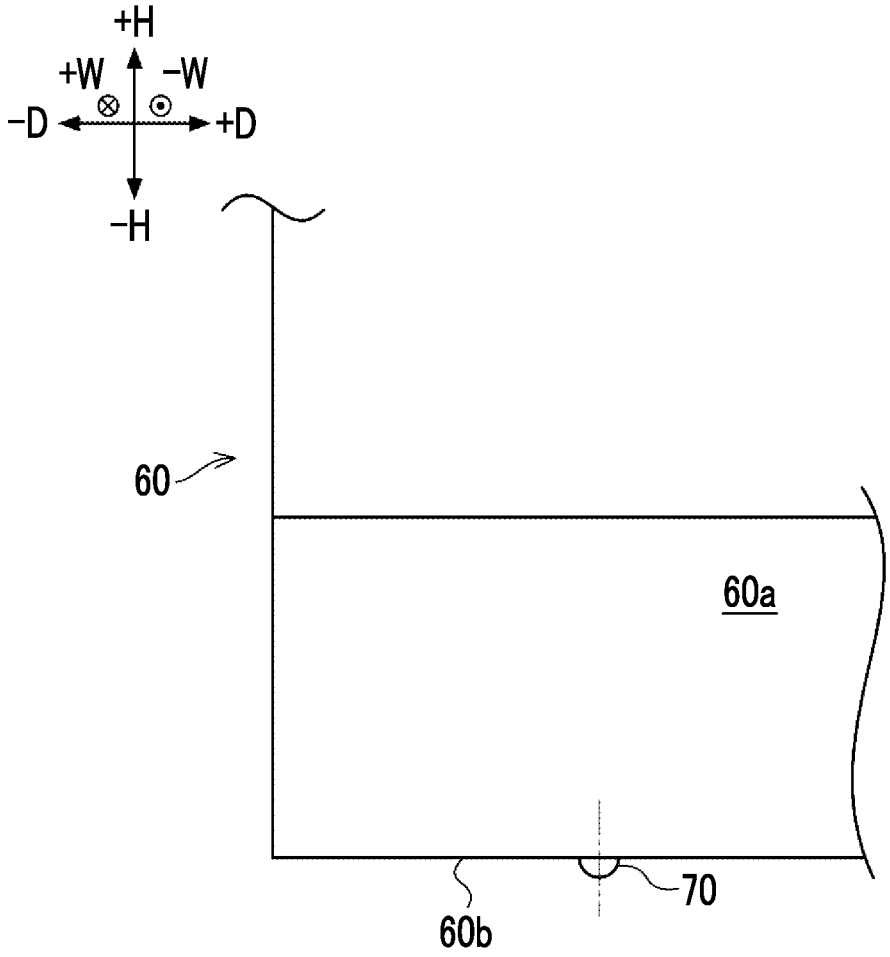
FIG. 6A is an enlarged side view of one end portion of a housing according to the exemplary embodiment of the present invention.
Figure 6B:
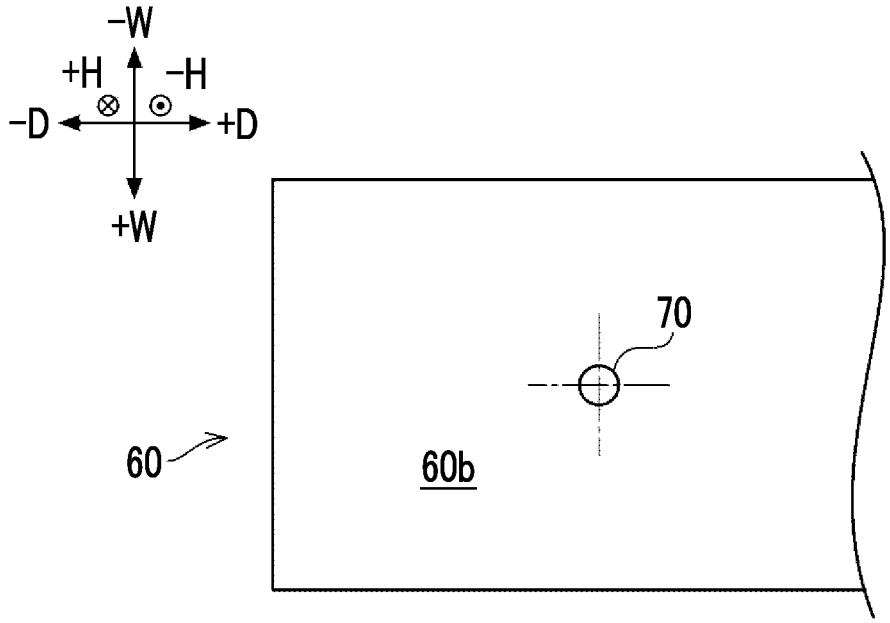
FIG. 6B is an enlarged bottom view of the one end portion of the housing according to the exemplary embodiment of the present invention.
Figure 7A:
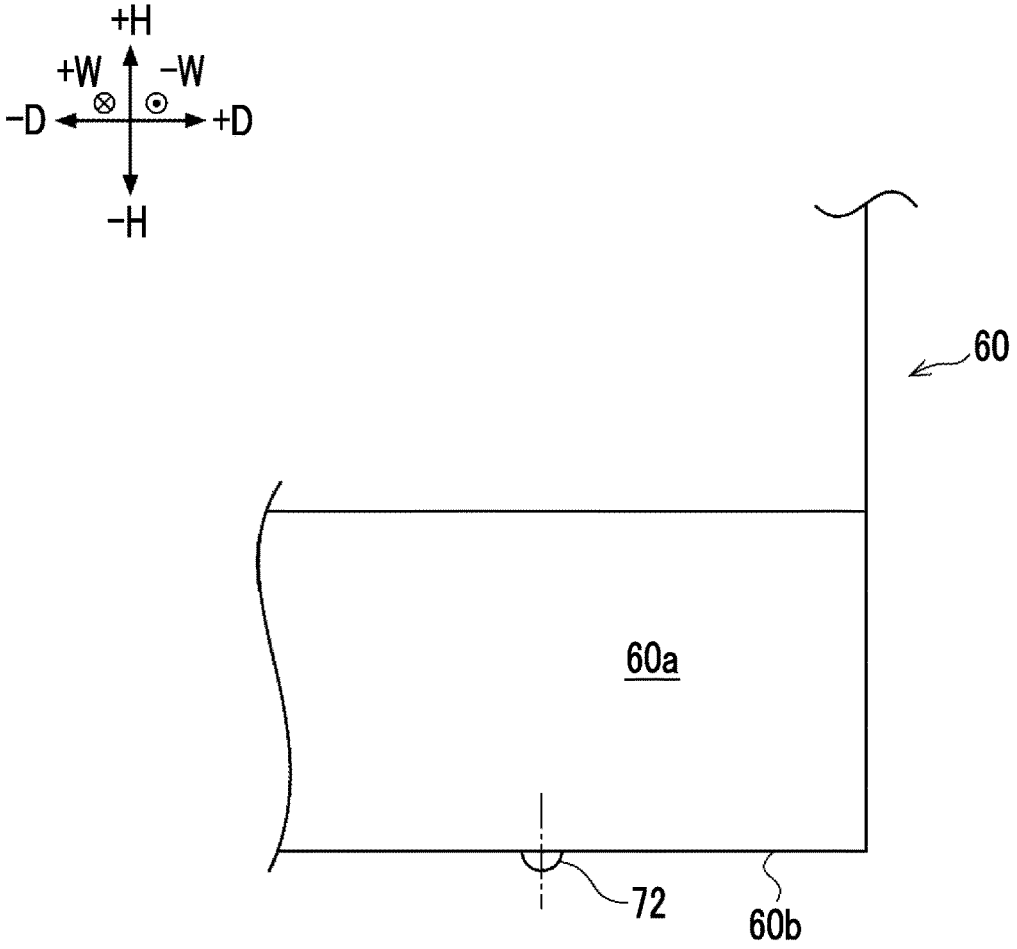
FIG. 7A is an enlarged side view of the other end portion of the housing according to the exemplary embodiment of the present invention.
Figure 7B:
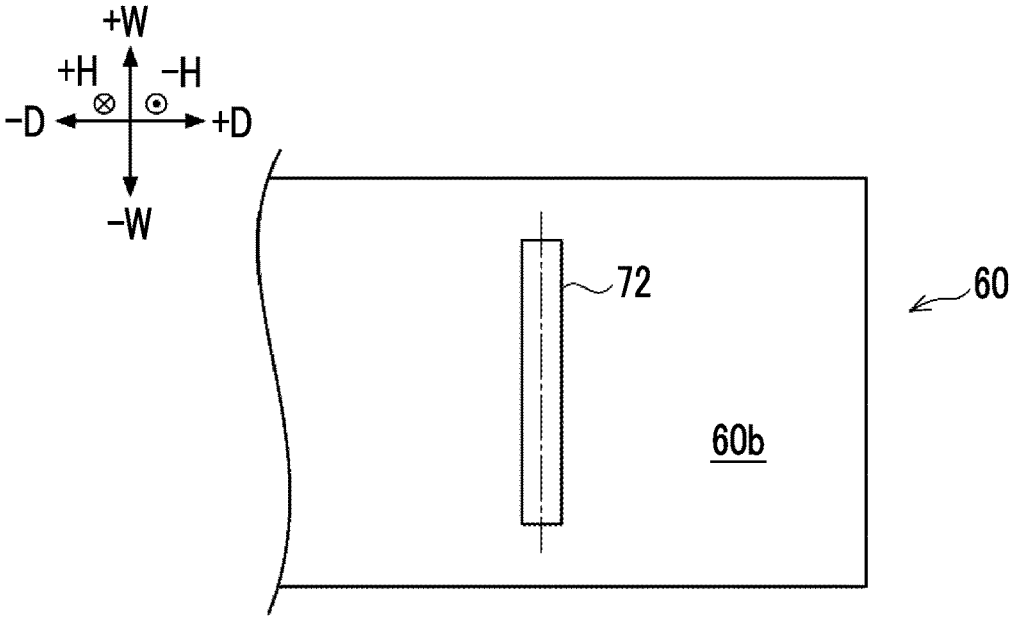
FIG. 7B is an enlarged bottom view of the other end portion of the housing according to the exemplary embodiment of the present invention.

As illustrated in FIG. 6A, a protruding portion 70 that protrudes downward from the lower surface portion 60*b* is formed on one (−D-direction) end portion of the lower surface portion 60*b* of the housing 60 in the apparatus depth direction. In addition, as illustrated in FIG. 7A, a protruding portion 72 that protrudes downward from the lower surface portion 60*b* is formed on the other (+D-direction) end portion of the lower surface portion 60*b* of the housing 60 in the apparatus depth direction. As illustrated in FIGS. 3, 6A, and 6B, the protruding portion 70 has a hemispherical shape. As illustrated in FIG. 7A, the protruding portion 72 has a semicircular shape in a case of being viewed from the apparatus width direction, and extends in the apparatus width direction. As illustrated in FIG. 1, each of the protruding portion 70 and the protruding portion 72 is formed on a part of the lower surface portion 60*b* of the housing 60, which overlaps the flat portion 68 of the housing 60 in the apparatus up-and-down direction in a case of being viewed from the apparatus width direction.

Each of the protruding portion 70 and the protruding portion 72 on the lower surface portion 60*b* of the housing 60 comes into contact with each end portion 86 of the suppressing member 80. As the protruding portion 70 has a hemispherical shape as described above, the protruding portion comes into point-contact with the end portion 86 of the suppressing member 80. As the protruding portion 72 extends in the apparatus width direction as described above and has a semicircular shape in a case of being viewed from the apparatus width direction, the protruding portion comes into line-contact with the end portion 86 of the suppressing member 80 in the apparatus width direction. The protruding portions 70 and 72 are examples of a contact portion.

Light Emitting Substrate 56

As illustrated in FIG. 2, the light emitting substrate 56 includes a substrate body 56*a* and a plurality of (for example, 30) LED arrays 56*b*.

The substrate body 56*a* is a rectangular plate member extending in the apparatus depth direction with the apparatus up-and-down direction as a thickness direction. The lengths of the substrate body 56*a* in the apparatus depth direction and the apparatus width direction are smaller than the lengths of the lower recessed portion 64 of the housing 60 in the apparatus depth direction and the apparatus width direction and larger than the lengths of the through-hole 66 in the apparatus depth direction and the apparatus width direction. As illustrated in FIGS. 3 and 4, the substrate body 56*a* is fixed to the housing 60 with an adhesive in a state of being in contact with the bottom surface 64*a* of the lower recessed portion 64 to cover the through-hole 66 from below.

As illustrated in FIG. 2, the LED arrays 56*b* are a plurality of LEDs that are arranged and mounted in a zigzag pattern along the apparatus depth direction on an upper surface of the substrate body 56*a* and emit light upward. Herein, the LEDs refer to light emitting diodes. The light emitting substrate 56 including the LED arrays 56*b* is an example of a light emitting unit. The light emitting substrate 56 generates heat as the LED arrays 56*b* emit light (irradiation).

Lens Array 52

As illustrated in FIG. 2, the lens array 52 is a rectangular parallelepiped member extending in the apparatus depth direction. Specifically, the lens array 52 is configured such that a plurality of rod lenses (cylindrical lenses), of which optical axes are in the apparatus up-and-down direction, are arranged in the apparatus depth direction in a zigzag pattern to be sandwiched between two plate members, and are bonded with an adhesive. The length of the lens array 52 in the apparatus depth direction is smaller than the length of the upper recessed portion 62 of the housing 60 in the apparatus depth direction and is larger than the length of the through-hole 66 in the apparatus depth direction. In addition, the height of the lens array 52 in the apparatus up-and-down direction is larger than the depth of the upper recessed portion 62 in the apparatus up-and-down direction. As illustrated in FIGS. 3 and 4, the lens array 52 is arranged in the upper recessed portion 62 such that a part including an upper surface portion of the lens array 52 protrudes from the upper recessed portion 62 in a case of being viewed from the apparatus depth direction and a lower surface portion of the lens array 52 covers the through-hole 66 from above. In this state, the lens array 52 is fixed to the housing 60 with an adhesive. In addition, a gap between the upper recessed portion 62 and the lens array 52 is filled with a sealing agent 58 over the entire periphery of the lens array 52.

The lens array 52 is arranged such that each LED of the LED arrays 56*b* faces each rod lens of the lens array 52 at a position determined in advance. In addition, when the flat portion 68 of the housing 60 is contact with the positioning member 90 of the photoconductor unit 18, the lens array 52 is arranged such that the upper surface portion of the lens array 52 faces the photoconductor drum 36 at a position determined in advance. Accordingly, the exposure device 50 can form an image (expose) of light that is emitted from the LED arrays 56*b* and is transmitted through the lens array 52 at a target position determined in advance on a surface of the photoconductor drum 36. The lens array 52 is an example of an optical member. In addition, the photoconductor drum 36 is an example of an exposure target. The exposure device 50 has a function of forming an image of light emitted from the LED arrays 56*b* on the charged photoconductor drum 36 to form an electrostatic latent image on the photoconductor drum 36.

Suppressing Member 80

As illustrated in FIG. 2, the suppressing member 80 is a member that is formed of a sheet metal and extends in the apparatus depth direction. As illustrated in FIGS. 1 to 5, the suppressing member 80 is fixed to the housing 60 to cover the lower recessed portion 64 of the housing 60 from below. The suppressing member 80 has a body portion 82, a bent portion 84, and the end portion 86.

As illustrated in FIGS. 2 to 4, the body portion 82 is a part that has a U-shaped section opened upward in a case of being viewed from the apparatus depth direction and extends in the apparatus depth direction. A pair of side walls and a bottom portion in the U-shaped section of the body portion refer to side walls 82*a* and a bottom portion 82*b*, respectively. As illustrated in FIGS. 3 and 4, the suppressing member 80 is arranged such that the bottom portion 82*b* of the body portion 82 is separated away from a lower surface of the housing 60 and the side surface portion 60*a* of the housing 60 is sandwiched between the pair of side walls 82*a*.

As illustrated in FIGS. 1 and 2, a plurality of through-holes 82*c* that are arranged in the apparatus depth direction and penetrate the side wall 82*a* in a plate thickness direction are formed in apart of each of the pair of side walls 82*a*, which overlaps the side surface portion 60*a* of the housing 60 in the apparatus width direction. The suppressing member 80 is fixed to the housing 60 with an adhesive that is injected into the through-holes 82*c* of the pair of side walls 82*a*, between which the side surface portion 60*a* of the housing 60 is sandwiched, and is cured.

The bent portion 84 is a rectangular part in a case of being viewed from the apparatus depth direction, which is arranged at each of both end portions of the bottom portion 82*b* in the apparatus depth direction, and has an L-shaped section extending in the apparatus up-and-down direction and the apparatus depth direction in a case of being viewed from the apparatus width direction. The bent portion 84 has a leg portion 84*a* that stands in the apparatus up-and-down direction and a bottom portion 84*b* that extends from a lower end of the leg portion 84*a* in the apparatus depth direction. The bottom portion 84*b* of the bent portion 84 is connected to the bottom portion 82*b* of the body portion 82. In other words, two bent portions 84 are arranged such that the body portion 82 is sandwiched therebetween in the apparatus depth direction. In addition, the leg portion 84*a* of the bent portion 84 is separated away from the lower surface of the housing 60. In addition, the leg portion 84*a* of the bent portion 84 is positioned between the protruding portion 70 and the protruding portion 72 of the housing 60 in the apparatus depth direction.

The end portion 86 is a rectangular part in a case of being viewed from the apparatus up-and-down direction, which is formed to spread from an upper end of the leg portion 84*a* toward an opposite side to the body portion 82 in a direction along the apparatus depth direction and the apparatus width direction. The suppressing member 80 is fixed to the housing 60 in a state where upper surfaces of the end portions 86 are in contact with the protruding portion 70 and the protruding portion 72 of the housing 60, respectively. In addition, in a case of being viewed from the apparatus width direction, each of the end portions 86 overlaps each of the flat portions 68 of the housing 60 in the apparatus up-and-down direction.

As the body portion 82 is fixed to the housing 60 such that the side surface portion 60*a* of the housing 60 is sandwiched, the suppressing member 80 has a function of making the housing 60 extending in the apparatus depth direction difficult to bend in the apparatus up-and-down direction, compared to the housing 60 alone. That is, the suppressing member 80 has a function of suppressing the deformation of the housing 60.

As illustrated in FIGS. 1, 3, and 4, the weight 54 is a member that has a rectangular parallelepiped shape extending in the apparatus depth direction and is fixed to a plate surface of the bottom portion 82*b* of the suppressing member 80, which is on an opposite side to the housing 60. As included in the exposure device 50, the weight 54 has a function of decreasing the natural frequency of the exposure device 50 compared to a case where the weight 54 is not included. Accordingly, the natural frequency of the exposure device 50 is deviated from the frequency of vibration generated inside the image forming apparatus 10.

Positioning Member 90

Each of the positioning members 90 is a member that is provided on a frame (not illustrated) of the image forming apparatus 10 and is arranged above the flat portion 68 of the housing 60. Each of the positioning members 90 has a contact surface 92 that is positioned at a position determined with respect to the photoconductor drum 36 in the apparatus up-and-down direction and faces downward. The positioning member 90 has a function of positioning the position of the exposure device 50 with respect to the photoconductor drum 36 in the apparatus up-and-down direction by bringing the flat portion 68 of the housing 60 into contact with the contact surface 92.

Biasing Unit 94

The biasing unit 94 is a mechanism configured to include, for example, a compression coil spring that is provided on the frame (not illustrated) of the image forming apparatus 10, is arranged below each of the end portions 86 of the suppressing member 80, and biases the end portion 86 upward. The biasing unit 94 has a contact surface 98 that comes into contact with a lower surface of each of the end portions 86. The biasing unit 94 has a function of coming into contact with the end portion 86 of the suppressing member 80 fixed to the housing 60 to bias the end portion 86 upward and biasing the lower surface portion 60*b* of the housing 60 via the end portion 86 to bring the flat portion 68 into contact with the contact surface 92 of the positioning member 90. In other words, the end portion 86 of the suppressing member 80 is interposed between the lower surface portion 60*b* of the housing 60 and the biasing unit 94. Specifically, the end portion 86 of the suppressing member 80 is interposed between the protruding portion 70 or the protruding portion 72 of the housing 60 and the biasing unit 94. That is, at least one end portion 86 of the suppressing member 80 in the apparatus depth direction is interposed between the lower surface portion 60*b* of the housing 60 and the biasing unit 94.

Operations And Effects

Next, operations and effects of the exemplary embodiment will be described. In the description, in a case of using the same component as the image forming apparatus 10 of the exemplary embodiment when describing a comparative embodiment with respect to the exemplary embodiment, description will be made using the reference sign and the name of the component without a change.

The light emitting device 50*a* of the exemplary embodiment has a configuration where at least one end portion 86 of the suppressing member 80 in the apparatus depth direction is interposed between the lower surface portion 60*b* of the housing 60 and the biasing unit 94. The light emitting device 50*a* of the exemplary embodiment and a light emitting device of the comparative embodiment to be described below will be compared to each other.

The light emitting device of the comparative embodiment includes a suppressing member configured only by the body portion 82, instead of the suppressing member 80. In other words, the suppressing member of the comparative embodiment does not have the bent portion 84 and the end portion 86. Thus, in the light emitting device of the comparative embodiment, the lower surface portion 60*b* of the housing 60 is in contact with the biasing unit 94, and is directly biased upward by the biasing unit 94. In other words, in the light emitting device of the comparative embodiment, the suppressing member is fixed to the housing 60 in a state of not being biased by the biasing unit 94. That is, in the light emitting device of the comparative embodiment, a load caused by the weight of the suppressing member is borne only by the housing 60. Except for the points above, the light emitting device of the comparative embodiment is configured the same as the light emitting device 50*a* of the exemplary embodiment.

As the suppressing member is fixed to the housing 60, the suppressing member provided in the light emitting device has a function of making the housing 60 extending in the apparatus depth direction difficult to bend in the apparatus up-and-down direction in the fixed range, compared to the housing 60 alone. However, as a load caused by the weight of the suppressing member is borne by the housing 60, there is a possibility that the suppressing member fixed to the housing 60 deforms the housing 60 outside the range where the body portion 82 is fixed.

On the other hand, in the light emitting device 50*a* of the exemplary embodiment, at least one end portion 86 of the suppressing member 80 is interposed between the lower surface portion 60*b* of the housing 60 and the biasing unit 94, and the suppressing member 80 is biased by the biasing unit 94. That is, in the light emitting device 50*a* of the exemplary embodiment, a load caused by the weight of the suppressing member is shared and borne by the housing 60 and the biasing unit 94.

Accordingly, in the light emitting device 50*a* of the exemplary embodiment, the deformation of the housing 60 caused by the weight of the suppressing member 80 is suppressed in a configuration where the suppressing member 80 is fixed to the housing 60, compared to a configuration where the housing 60 directly receives a biasing force from the biasing unit 94 with the lower surface portion 60*b*.

In addition, the light emitting device 50*a* of the exemplary embodiment has a configuration where each of the end portions 86 of the suppressing member 80 on both sides in the apparatus depth direction is interposed between the lower surface portion 60*b* of the housing 60 and the biasing unit 94. Accordingly, in the light emitting device 50*a* of the exemplary embodiment, the deformation of the housing 60 caused by the weight of the suppressing member 80 is suppressed, compared to a configuration where only one end portion 86 of the suppressing member 80 is interposed between the lower surface portion 60*b* of the housing 60 and the biasing unit 94.

In addition, the light emitting device 50*a* of the exemplary embodiment has a configuration where the body portion 82 and the bent portion 84 of the suppressing member 80 are separated away from the lower surface portion 60*b* of the housing 60.

The suppressing member 80 fixed to the housing 60 of the light emitting device 50*a* is thermally deformed by heat generated as the light emitting substrate 56 of the light emitting device 50*a* emits light. There is a possibility that the housing 60, to which the suppressing member 80 is fixed, deforms as the suppressing member 80 thermally deforms.

In a configuration where the suppressing member 80 is fixed to the housing 60 of the light emitting device 50*a*, the body portion 82 and the bent portion 84 of the suppressing member 80 of the exemplary embodiment are separated away from the lower surface portion 60*b* of the housing 60. In other words, the light emitting device 50*a* of the exemplary embodiment has a configuration where a part between the end portions 86 of the suppressing member 80 on both sides is separated away from the lower surface of the housing 60. That is, in the light emitting device 50*a* of the exemplary embodiment, a contact area between the suppressing member 80 and the housing 60 is small, compared to a configuration where the entire suppressing member is in contact with the lower surface of the housing 60 in the apparatus up-and-down direction. Accordingly, in the light emitting device 50*a* of the exemplary embodiment, the deformation of the housing 60 caused by the deformation of the suppressing member 80 is suppressed, compared to a configuration where the entire suppressing member is in contact with the lower surface of the housing 60 in the apparatus up-and-down direction.

In addition, the light emitting device 50*a* of the exemplary embodiment has a configuration where the protruding portion 70 and the protruding portion 72 that come into point-contact or line-contact with the end portions 86 of the suppressing member 80 are formed on the lower surface portion 60*b* of the housing 60. In other words, the light emitting device 50*a* of the exemplary embodiment has, on any one of the end portion 86 of the suppressing member 80 or the lower surface portion 60*b* of the housing 60, the contact portion that comes into point-contact or line-contact with the other one of the end portion 86 of the suppressing member 80 or the lower surface portion 60*b* of the housing 60. That is, the light emitting device 50*a* of the exemplary embodiment has a small contact area between the suppressing member 80 and the housing 60, compared to a configuration where the end portion 86 of the suppressing member 80 and the lower surface portion 60*b* of the housing 60 come into surface-contact with each other. Accordingly, in the light emitting device 50*a* of the exemplary embodiment, the deformation of the housing 60 caused by the deformation of the suppressing member 80 is suppressed, compared to a configuration where the end portion 86 of the suppressing member 80 and the lower surface portion 60*b* of the housing 60 come into surface-contact with each other.

In addition, the light emitting device 50*a* of the exemplary embodiment has a configuration where the protruding portion 72 of the housing 60 comes into line-contact with one end portion 86 of the suppressing member 80 in the apparatus width direction. In other words, in the light emitting device 50*a* of the exemplary embodiment, at least one contact portion on any one of the end portion 86 of the suppressing member 80 or the lower surface portion 60*b* of the housing 60 comes into line-contact with the other one of the end portion 86 or the lower surface portion 60*b* in the apparatus width direction. Accordingly, in the light emitting device 50*a* of the exemplary embodiment, the posture of the light emitting device 50*a* biased by the biasing unit 94 via the suppressing member 80 is stable, compared to a configuration where the end portions 86 on both sides come into point-contact with the lower surface portion 60*b*.

In addition, the light emitting device 50*a* of the exemplary embodiment has a configuration where the protruding portion 70 and the protruding portion 72 are provided in the housing 60. Accordingly, in the light emitting device 50*a* of the exemplary embodiment, forming the suppressing member 80 is easy, compared to a configuration where the contact portion that comes into point-contact or line-contact with the lower surface portion 60*b* of the housing 60 is provided in the suppressing member 80.

In addition, in the exposure device 50 including the light emitting device 50*a* of the exemplary embodiment, exposure failure is suppressed, compared to a configuration where the housing 60 of the light emitting device included in the exposure device directly receives a biasing force from the biasing unit 94 with the lower surface portion 60*b*.

In addition, in the image forming apparatus 10 including the exposure device 50 of the exemplary embodiment, image formation failure is suppressed, compared to a configuration where the housing 60 of the light emitting device included in the exposure device directly receives a biasing force from the biasing unit 94 with the lower surface portion 60*b*.

As described above, although the specific exemplary embodiment of the present invention has been described in detail, the present invention is not limited to the exemplary embodiment, and can undergo various deformations, changes, and improvements without departing from the technical scope of the present invention.

For example, in the light emitting device 50*a* of the exemplary embodiment, the end portions 86 of the suppressing member 80 on both sides in the apparatus depth direction are interposed between the lower surface portion 60*b* of the housing 60 and the biasing unit 94. However, the light emitting device according to the exemplary embodiment of the present invention may have a configuration where only one end portion 86 in the apparatus depth direction is interposed between the lower surface portion 60*b* of the housing 60 and the biasing unit 94.

In addition, in the light emitting device 50*a* of the exemplary embodiment, the part between the end portions 86 of the suppressing member 80 on both sides is separated away from the lower surface portion 60*b* of the housing 60. However, insofar as at least one end portion 86 in the apparatus depth direction is interposed between the lower surface portion 60*b* of the housing 60 and the biasing unit 94, the light emitting device according to the exemplary embodiment of the present invention may have a configuration where the entire suppressing member is in contact with the lower surface of the housing 60 in the apparatus up-and-down direction.

In addition, in the light emitting device 50*a* of the exemplary embodiment, any one of the end portion 86 of the suppressing member 80 or the lower surface portion 60*b* of the housing 60 comes into point-contact or line-contact with the other one of the end portion 86 or the lower surface portion 60*b*. However, insofar as at least one end portion 86 in the apparatus depth direction is interposed between the lower surface portion 60*b* of the housing 60 and the biasing unit 94, the light emitting device according to the exemplary embodiment of the present invention may have a configuration where the end portion 86 of the suppressing member 80 and the lower surface portion 60*b* of the housing 60 come into surface-contact with each other. In this case, the housing 60 may not have the protruding portion that comes into contact with the end portion 86 of the suppressing member 80 on the lower surface portion 60*b*.

In addition, in the light emitting device 50*a* of the exemplary embodiment, the contact portions where any one of the end portion 86 of the suppressing member 80 or the lower surface portion 60*b* of the housing 60 comes into point-contact or line-contact with the other one of the end portion 86 or the lower surface portion 60*b* are the protruding portion 70 and the protruding portion 72 which are formed on the housing 60. However, the contact portions according to the exemplary embodiment of the present invention may be formed on the suppressing member 80.

In addition, the light emitting device 50*a* of the exemplary embodiment includes the protruding portion 70 where the end portion 86 of the suppressing member 80 and the lower surface portion 60*b* of the housing 60 come into point-contact with each other and the protruding portion 72 where the end portion 86 and the lower surface portion 60*b* come into line-contact with each other. However, the light emitting device according to the exemplary embodiment of the present invention may have a configuration of including only one of the protruding portion 70 or the protruding portion 72. In addition, the light emitting device according to the exemplary embodiment of the present invention may have a configuration where the plurality of protruding portions 70 arranged in the apparatus width direction are formed, instead of the protruding portion 72. In addition, the light emitting device according to the exemplary embodiment of the present invention may have a configuration where the protruding portion that comes into line-contact with the end portion 86 in the apparatus depth direction is formed, instead of the protruding portion 70. In a configuration where the protruding portions 70 are formed on end portions of the housing 60 on both sides in the apparatus width direction, in a case where only one protruding portion 70 is formed on one end portion, for example, the plurality of protruding portions 70 having positions in the apparatus width direction different from each other are formed on the other end portion.

In addition, in the light emitting device 50*a* of the exemplary embodiment, the end portion 86 of the suppressing member 80 and the lower surface portion 60*b* of the housing 60 come into line-contact with each other at the protruding portion 72 in the apparatus width direction. However, the light emitting device according to the exemplary embodiment of the present invention may have a configuration where the end portion 86 of the suppressing member 80 and the lower surface portion 60*b* of the housing 60 come into line-contact with each other in the apparatus depth direction. In addition, the light emitting device according to the exemplary embodiment of the present invention may have a configuration where the end portions 86 of the suppressing member 80 on both sides and both end portions of the lower surface portion 60*b* of the housing 60 come into line-contact with each other in the apparatus depth direction. In a case where the protruding portions that come into contact with the end portions 86 of the suppressing member 80 respectively in the apparatus depth direction are formed on both end portions of the housing 60 in the apparatus width direction, for example, the protruding portions are deviated from each other in the apparatus width direction. In addition, in a case where the protruding portions that come into line-contact with the end portions 86 of the suppressing member 80 respectively are formed on both end portions of the housing 60 in the apparatus width direction, for example, imaginary straight lines of the protruding portions along longitudinal directions thereof intersect each other.

In addition, the light emitting device 50*a* of the exemplary embodiment is included in the exposure device 50 that forms an image of light on the charged photoconductor drum 36 to form an electrostatic latent image. However, the light emitting device according to the exemplary embodiment of the present invention is not limited to the light emitting device included in the exposure device. For example, the light emitting device according to the exemplary embodiment of the present invention may be included in a reading unit (for example, a contact image sensor).

In addition, the light emitting device 50*a* of the exemplary embodiment is biased from below by the biasing unit 94 and emits light upward. However, the light emitting device according to the exemplary embodiment of the present invention may have a configuration of being biased downward from above by the biasing unit and emitting light downward along a biasing direction of the biasing unit. In addition, the light emitting device according to the exemplary embodiment of the present invention may have a configuration of being biased by the biasing unit in an inclination direction inclined along the height direction and emitting light in the inclination direction along the biasing direction of the biasing unit.

In addition, in the light emitting device 50*a* of the exemplary embodiment, parts of the lower surface portion 60*b* of the housing 60, on which the protruding portion 70 and the protruding portion 72 are formed, overlap the flat portions of the housing 60, which come into contact with the positioning members 90, in the apparatus up-and-down direction in a case of being viewed from the apparatus width direction. That is, in the light emitting device according to the exemplary embodiment of the present invention, in a case of being viewed from the apparatus depth direction, the housing 60 comes into contact with the positioning members 90 on the plurality of contact surfaces, and the contact surfaces may not overlap the protruding portion 70 or the protruding portion 72 in the apparatus up-and-down direction. In this case, for example, in a case of being viewed from the apparatus depth direction, a center line of the housing 60 according to the exemplary embodiment of the present invention with respect to the plurality of contact surfaces with the positioning members 90, which extends in the apparatus up-and-down direction, overlaps the protruding portion 70 or the protruding portion 72.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light emitting device comprising:

a resin housing that extends in one direction and holds a light emitting unit emitting light upward in a height direction intersecting the one direction, the housing having, on an upper side and a lower side of each of both end portions in the one direction, a positioned portion, which comes into contact with a positioning member in the height direction, and a biased portion, which receives a biasing force from a biasing unit biasing the housing to bring the positioned portion into contact with the positioning member; and a suppressing member that extends in the one direction and is fixed to the housing to suppress deformation of the housing, at least one end portion of the suppressing member the one direction being interposed between the biased portion and the biasing unit, wherein a part between the end portions of the suppressing member on both sides in the one direction is separated away from a lower surface of the housing.

2. The light emitting device according to claim 1, wherein each of the end portions of the suppressing member on both sides in the one direction are interposed between the biased portion and the biasing unit.

3. The light emitting device according to claim 2, wherein any one of the end portion or the biased portion has a contact portion that comes into point-contact or line-contact with the other one of the end portion or the biased portion.

4. The light emitting device according to claim 3, wherein at least one contact portion comes into line-contact with the other one of the end portion or the biased portion in a direction intersecting the one direction and the height direction.

5. The light emitting device according to claim 4, wherein the contact portion is provided in the housing.

6. The light emitting device according to claim 3, wherein the contact portion is provided in the housing.

7. The light emitting device according to claim 2, wherein any one of the end portion or the biased portion has a contact portion that comes into point-contact or line-contact with the other one of the end portion or the biased portion.

8. The light emitting device according to claim 7, wherein at least the one contact portion comes into line-contact with the other one of the end portion or the biased portion in a direction intersecting the one direction and the height direction.

9. The light emitting device according to claim 8, wherein the contact portion is provided in the housing.

10. The light emitting device according to claim 7, wherein the contact portion is provided in the housing.

11. The light emitting device according to claim 1, wherein any one of the end portion or the biased portion has a contact portion that comes into point-contact or line-contact with the other one of the end portion or the biased portion.

12. The light emitting device according to claim 11, wherein each of the end portions of the suppressing member on both sides in the one direction is interposed between the biased portion and the biasing unit, and at least one contact portion comes into line-contact with the other one of the end portion or the biased portion in a direction intersecting the one direction and the height direction.

13. The light emitting device according to claim 12, wherein the contact portion is provided in the housing.

14. The light emitting device according to claim 11, wherein the contact portion is provided in the housing.

15. An exposure device comprising:

the light emitting device according to claim 1; and an optical member that exposes an exposure target with light emitted by the light emitting device.

16. An image forming apparatus comprising:

an image holder;

the exposure device according to claim 15 that forms an image of light on the charged image holder to form an electrostatic latent image;

a positioning member that positions a position of the exposure device with respect to the image holder in the height direction by coming into contact with the positioned portion;

a biasing unit that biases the housing via the end portion to bring the positioned portion into contact with the positioning member; and a developing device that develops the electrostatic latent image on the image holder to form an image.

17. The light emitting device according to claim 1, wherein the suppressing member comprises a body portion and the end portion, and the bottom portion of the body portion is separated away from a lower surface of the housing.

* * * * *